US005222909A

United States Patent [19]

Nomura et al.

[11] Patent Number: 5,222,909

[45] Date of Patent: Jun. 29, 1993

[54] DEMOUNTABLE SHIELD CONNECTOR

[75] Inventors: Fumihiko Nomura; Takahiro Yoneda, both of Kanagawa; Takayoshi Endo, Shizuoka; Sakai Yagi, Shizuoka; Shigemitsu Inaba, Shizuoka; Satoshi Yamada, Shizuoka; Toru Nagano, Shizuoka, all of Japan

[73] Assignee: Yazaki Corporation, Tokyo, Japan

[21] Appl. No.: 940,386

[22] Filed: Sep. 3, 1992

[30] Foreign Application Priority Data

Sep. 12, 1991 [JP] Japan ..... 3-73507[U]

[51] Int. Cl.[5] ..... H01R 13/648

[52] U.S. Cl. ..... 439/607; 439/271; 439/610

[58] Field of Search ..... 439/92, 101, 108, 271-273, 439/607, 608, 609, 610, 701

[56] References Cited

U.S. PATENT DOCUMENTS

| | | | |
|---|---|---|---|
| 4,820,204 | 4/1989 | Batty | 439/701 X |
| 4,954,097 | 9/1990 | Sekiguchi | 439/610 X |
| 4,981,447 | 1/1991 | Ichitsubo | 439/607 |
| 4,986,779 | 1/1991 | Ferrill et al. | 439/108 |
| 5,035,652 | 7/1991 | Shibano | 439/610 |

FOREIGN PATENT DOCUMENTS 63-127083 8/1988 Japan .

*Primary Examiner*—Larry I. Schwartz
*Assistant Examiner*—Khiem Nguyen
*Attorney, Agent, or Firm*—Armstrong, Westerman, Hattori, McLeland & Naughton

[57] ABSTRACT

A shield connector wherein maintenance thereof such as replacement of terminals can be performed readily and admission of water is prevented. The shield connector comprises a tubular outer housing made of an insulating resin material, a tubular metal shell inserted in the outer housing and having a semi-annular contacting portion formed thereon, an inner housing made of an insulating resin material and inserted in the metal shell, a plurality of terminals removably accommodated in the inner housing and connected to a shield cable, a rear shell removably fitted in the metal shell and having a semi-annular contacting portion formed thereon, an annular cap made of an insulating resin material for removably holding therein the semi-annular contacting portions of the metal shell and the rear shell with a shield portion of the shield cable inserted between the semi-annular contacting portions, and a rear cover made of a synthetic resin material and removably fitted with a rear end portion of the outer housing. The shield cable extends through the rear cover.

4 Claims, 6 Drawing Sheets

DEMOUNTABLE SHIELD CONNECTOR

BACKGROUND OF THE INVENTION

1. Field of the Invention

This invention relates to a demountable shield connector which prevents admission of electromagnetic waves and/or water.

2. Description of the Prior Art

A shield connector is already known and disclosed, for example, in Japanese Utility Model Laid-Open Application No. 63-127093. The shield connector is shown in FIG. 7.

Referring to FIG. 7, the shield connector is generally denoted at 100 and includes a tubular metal shell 102 having a stopping step or shoulder 101 at a front end portion thereof and having an opening at the rear end thereof. An inner housing 105 made of an insulating resin material is fitted in the metal shell 102, and a plurality of terminals 104 are accommodated in the inner housing 105 and individually connected to a shield cable 103. A rear shell 109 made of a metal is secured at 110 to a rear end portion of the metal shell 102 by caulking. The rear shell 109 is secured at 108 to a coating 107 of the shield cable 103 by caulking and retained on a braided shield 106 of the shield cable 103. A holding member 111 made of a resin material is retained on the rear shell 109, and an outer housing 112 made of an insulating resin material is provided on the outer profile of the metal shell 102 with a front arresting pawl 113 of the former engaged with the stopping step 101 of the latter.

A companion shield connector (not shown) having a similar construction to the shield connector 100 and cooperating with the shield connector 100 to constitute a shield connector assembly is fitted with a front portion of the shield connector 100 such that the terminals of them are connected to each other and the metal shells 102 are fitted with each other. Thus, electromagnetic waves from the outside are absorbed by the metal shells 102 and the rear shells 109 and grounded by way of the braided shields 106 of the shield cables 103. Accordingly, electromagnetic waves are absorbed over the entire connector assembly, and consequently, generation of electric noise is prevented.

The conventional shield connector 100 of the structure described above, however, is disadvantageous in that, since the rear shell 109 is secured to the metal shell 102 by caulking and the rear shell 109 is securely mounted on the shield cable 103 by caulking, the inner housing 105 is enclosed in the metal shell 102, which makes it impossible to perform maintenance such as replacement of the terminals 104. Further, since the conventional shield connector 100 does not have a waterproof mechanism, it cannot be installed at a location at which it may come across water such as an engine room of an automobile.

SUMMARY OF THE INVENTION

It is an object of the present invention to provide a shield connector wherein maintenance thereof such as replacement of terminals can be performed readily.

It is another object of the present invention to provide a shield connector which can prevent admission of water.

In order to attain the objects, according to the present invention, there is provided a demountable shield connector which comprises a tubular outer housing made of an insulating resin material, a tubular metal shell inserted in and retained on the outer housing and having a semi-annular contacting portion formed at a rear portion thereof, an inner housing made of an insulating resin material and inserted in and retained on the metal shell, a shield cable, a plurality of terminals removably accommodated in the inner housing and connected to the shield cable, a rear shell fitted in and removably retained at a rear portion of the metal shell in such a manner as to close a rear end opening of the metal shell and having a semi-annular contacting portion formed at a rear portion thereof for cooperating with the semi-annular contacting portion of the metal shell, an annular cap made of an insulating resin material for removably holding therein the semi-annular contacting portions of the metal shell and the rear shell in an opposing relationship with each other with a shield portion of the shield cable inserted between the semi-annular contacting portions, and a rear cover made of a synthetic resin material and fitted with and removably retained at a rear end portion of the outer housing, the shield cable extending through the rear cover.

In the shield connector, the components are assembled in the following manner. First, the metal shell is inserted in position into the outer housing. Then, the inner housing in which the terminals are accommodated are inserted in position into the metal shell. Then, the rear shell is engaged with the metal shell such that the semi-annular contacting portions of the metal shell and the rear shell are contacted with the shield portion of the shield cable, and in this condition, the annular cap is fitted onto the semi-annular contacting portions so that the shield portion of the shield cable may be held tightly between the semi-annular contacting portions. Finally, the rear cover is fitted with the rear end portion of the outer housing.

With the shield connector, the components thereof can be assembled and disassembled readily into and from several units. In particular, the terminals can be removed from the inner housing assembled to the outer housing and the metal shell; the rear shell can be removed from the metal shell; the annular cap can be removed from the metal shell and the rear shell; and the rear cover can be removed from the outer housing. Accordingly, replacement of a component or components of the shield connector such as, for example, the terminals, for maintenance can be performed readily, and consequently, the shield connector is very economical comparing with such a conventional shield connector as described hereinabove which requires, when it fails, replacement of the entire shield connector.

Preferably, a waterproof seal rubber member is provided integrally at each of a portion of the rear cover from which the shield cable extends outwardly and another portion of the rear cover at which the rear cover is fitted with the metal shell, and a seal rubber member is fitted at a front end portion of the outer housing for contacting with the outer housing of a companion shield connector adapted to cooperate with the shield connector to make up a shield connector assembly. When the shield connector is assembled to the companion shield connector, the waterproof means prevent admission of water into the shield connector assembly completely. Consequently, the shield connector assembly can be used at a location where water may come across the same such as an engine room of an automobile, which expands the field of application of the shield connector.

Preferably, the annular cap has an inner circumferential face the diameter of which increases away from the metal shell so as to facilitate insertion of the semi-annular contacting portions of the metal shell and the rear shell into the annular cap.

Preferably, the demountable shield connector further comprises a holder removably retained on the inner housing and holding the terminals thereon. Since the terminals are held on the holder which is removably retained on the inner housing, the terminals can be accommodated further readily into the inner housing.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
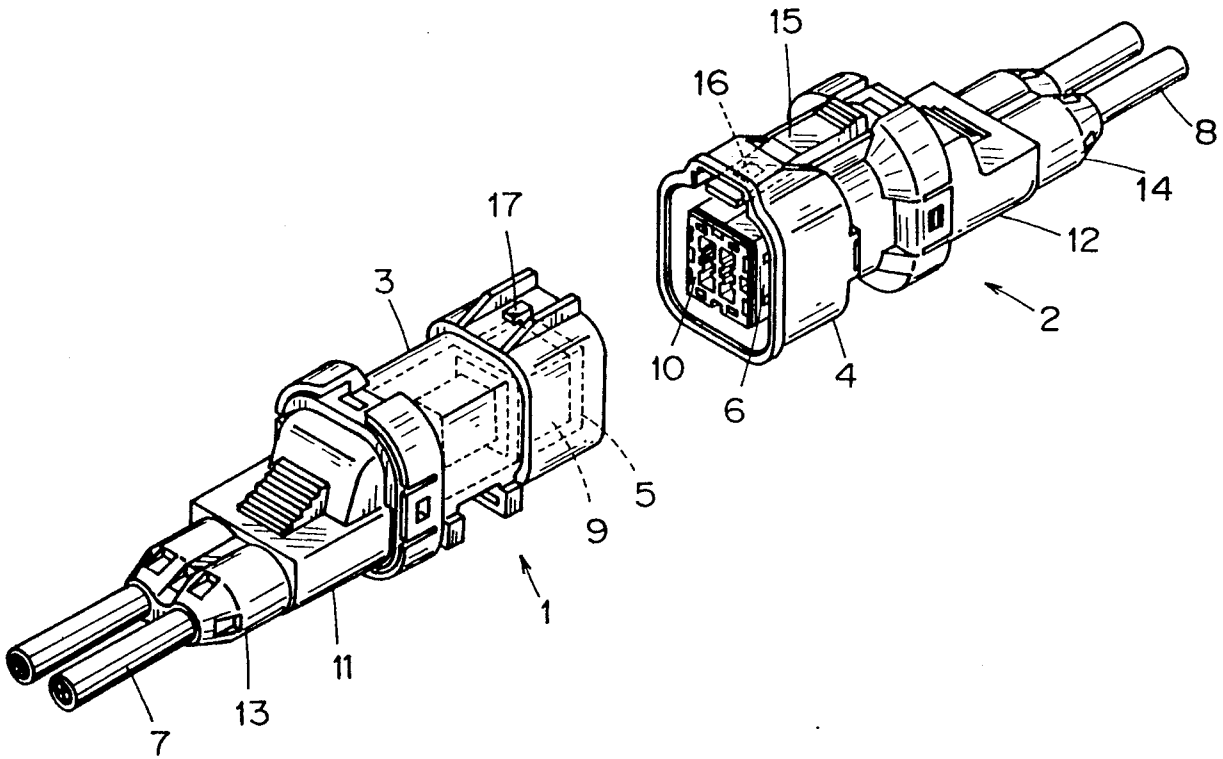
FIG. 1 is a perspective view of a shield connector assembly in a demounted condition showing a preferred embodiment of the present invention.

Referring first to FIG. 1, there is shown a demountable shield connector assembly according to a preferred embodiment of the present invention. The shield connector assembly includes a male connector 1 and a female connector 2. Each of the male and female connectors 1 and 2 is generally composed of an outer housing 3 or 4 made of an insulating resin material, a shielding conductive metal shell 5 or 6 retained in the outer housing 3 or 4, an inner housing 9 or 10 made of an insulating resin material, and a rear cover 11 or 12 made of a synthetic resin material and fitted with a rear portion of the outer housing 3 or 4. Each of the inner housings 9 and 10 is retained in the metal shell 5 or 6 and accommodates therein a plurality of terminals (not shown) connected to a pair of shield cables 7 or 8.

A waterproof seal member 13 or 14 made of an oil-containing silicon rubber is formed integrally at a rear portion of each of the rear covers 11 and 12. The male connector 1 and the female connector 2 are coupled to each other by arresting engagement between an arresting hole 16 of a locking arm 15 formed on the female connector outer housing 4 and an arresting projection 17 provided on the male connector outer housing 3.

Figure 2:
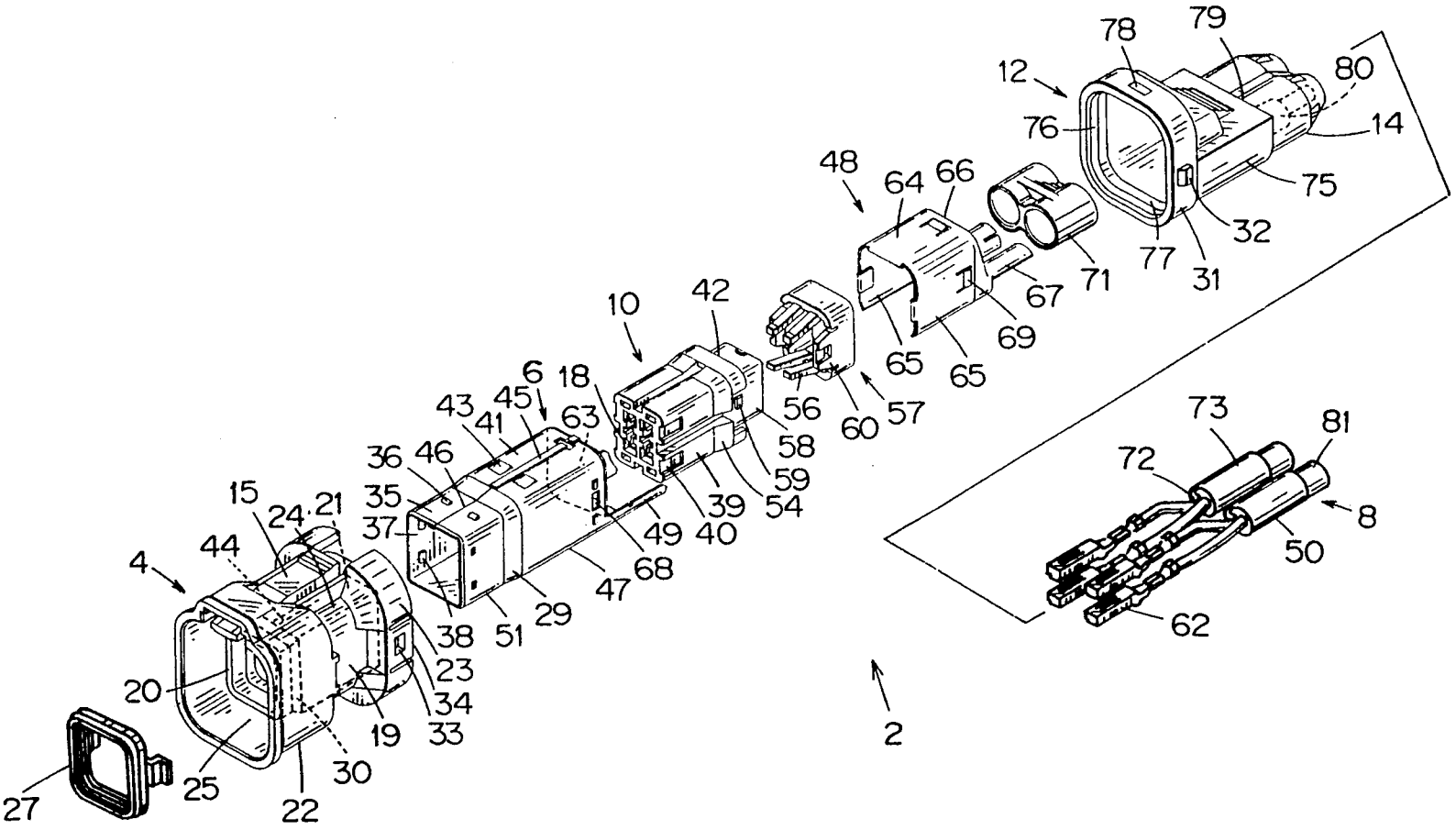
FIG. 2 is a fragmentary perspective view showing components of a female connector of the shield connector assembly shown in FIG. 1.
Figure 3:
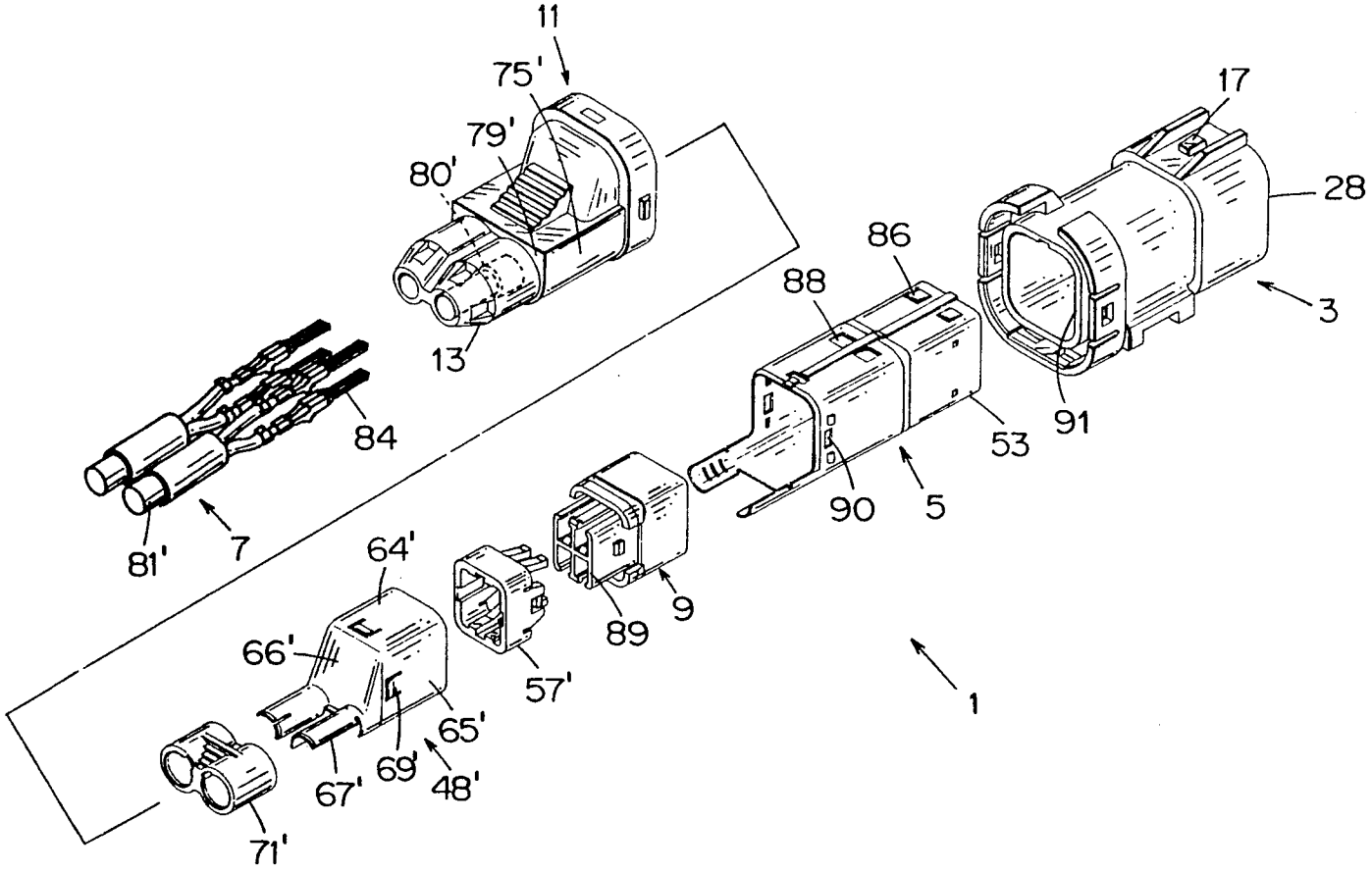
FIG. 3 is a similar view but showing components of a male connector of the shield connector assembly shown in FIG. 1.

Internal structures of the female and male connectors 2 and 1 are shown more in detail in FIGS. 2 and 3, respectively. Since the internal structures of the connectors 1 and 2 are generally similar to each other, description will be given mainly of the female connector 2 shown in FIG. 2. Referring to FIG. 2 and also to FIG. 4 in which assembly of the female connector 2 is illustrated, the female connector outer housing 4 has a substantially rectangular tubular configuration, and also the metal shell 6 has a substantially rectangular tubular configuration. The inner housing 10 has a plurality of terminal accommodating chambers 18 formed therein.

The female connector outer housing 4 has a rectangular tubular inner wall 19 and has a pair of annular outer walls 22 and 23 formed on the outer sides of a front end portion 20 and a rear end portion 21 of the inner wall 19, respectively. The locking arm 15 is provided on an upper wall 24 of the female connector outer housing 4. The outer wall front end portion 22 extends forwardly farther than the inner wall front end portion 20 while the outer wall rear end portion 23 is positioned substantially in flush with the inner wall rear end portion 21.

A circumferential groove 25 is formed between the inner wall front end portion 20 and the outer wall front end portion 22 of the female connector outer housing 4, and a rectangular waterproof seal member 27 is fitted in the circumferential groove 25. An annular front end portion 28 (refer to FIG. 3) of the male connector 1 is engaged in the circumferential groove 25 in a closely contacting relationship with the seal member 27.

A stopping inclined step 30 for engaging with an inclined step 29 at an intermediate portion of the metal shell 6 is formed on the rectangular tubular inner wall 19 of the female connector outer housing 4, and a flexible locking tab 34 is formed at the outer wall rear end portion 23 of the outer housing 4. The flexible locking tab 34 has an arresting hole 33 formed therein for engaging with an arresting projection 32 formed at a front end portion 31 of the rear cover 12.

A plurality of climbing over arresting projections 36 for engaging with the inner wall front end portion 20 of the outer housing 4 is formed on an upper wall outer face 35 of a front portion of the metal shell 6, and a plurality of engaging projections 38 for engaging with a plurality of guide grooves 40 formed at a front end portion of an outer side wall 39 of the inner housing 10 are formed on a side wall inner face 37 of the front portion of the metal shell 6. A plurality of arresting pawls 43 for engaging with an intermediate step 42 of the inner housing 10 are provided on an inner wall of an upper wall 41 by cutting and raising the upper wall 41 of the metal shell 6 inwardly. An engaging rib 45 for engaging with a guide groove 44 formed on the inner wall 19 of the outer housing 4 is formed on an outer face of the upper wall 41 of the metal shell 6. The engaging rib 45 extends outwardly upwardly from a central joining line 46 of the upper wall 41.

A pair of semi-annular contacting portions 49 extend from a rear portion of a bottom wall 47 of the metal shell 6. The semi-annular contacting portions 49 constitute, when a rear shell 48, which will be hereinafter described, is attached thereto, a connecting portion to shield portions 50 of the shield cables 8. The metal shell 6 is inserted into the outer housing 4 along the inner wall 19 of the outer housing 4 and fixed in position such that a front end portion 51 thereof extends forwardly farther than the inner wall front end portion 20 of the outer housing 4. A front end portion 53 of the metal shell 5 of the male connector 1 shown in FIG. 3 is inserted in the front end portion 51 of the metal shell 6.

A stopping inclined step 54 for engaging with the inclined step 29 of the metal shell 6 is formed at a location of the inner housing 10 forwardly of the intermediate step 42.

A rear holder 57 made of an insulating resin material is fitted in a rear portion of the inner housing 10. The rear holder 57 has a double arresting finger 56 for preventing pulling off of terminals 62 inserted in the terminal accommodating chambers 18 of the inner housing 10. A locking tab 60 for engaging with an arresting projection 59 provided on a rear side wall 58 of the inner housing 10 is formed on the rear holder 57.

The inner housing 10 in which the female terminals 62 and the rear holder 57 are fitted are retained in the metal shell 6, and the rear shell 48 made of a conductive metal is inserted into and engaged with the metal shell 6.

It is to be noted that alternatively the female terminals 62 and the rear holder 57 may be inserted into the inner hosing 10 which is assembled in advance to the outer housing 4.

The rear shell 48 is constructed such that, as shown in FIG. 3 in which reference numerals are indicated with the mark "'" applied to portions thereof, the opposite side faces 65 and a rear face 66 are formed downwardly from an upper wall 66 and a pair of semi-annular contacting portions 67 are formed at a lower portion of the rear wall 66 in an opposing relationship to the semi-annular contacting portions 49 of the metal shell 6. A plurality of arresting pawls 69 for engaging with arresting holes 68 provided at a rear end portion of the metal shell 6 are formed individually on the upper and side walls 64 and 65 of the rear shell 48 by cutting and raising the rear shell 48.

The shield portions 50 of the shield cables 8 are inserted in position in the contacting portions 49 and 67 of the metal shell 6 and the rear shell 48 while an annular insulating resin cap 71 is fitted on outer peripheral faces of the contacting portions 49 and 67 to hold the shield portions 50 of the shield cables 8 between the opposing contacting portions 49 and 67. The shield portions 50 are each formed by bending a drain wire (grounding wire) 72 back on itself and winding a conductive tape 73 around the bent back drain wire 72. The insulating resin cap 71 has a pair of inner peripheral faces 71*a* each of which is shaped into such a tapered configuration that the diameter thereof increases forwardly as seen in FIG. 4 in order to facilitate insertion of the semi-annular contacting portions 49 and 67 into the insulating resin cap 71.

Finally, the rear cover 12 made of a synthetic resin material is fastened to the rear end portion 23 of the outer housing 4. The members 6, 10, 57, 48 and 71 are accommodated in the inside of the outer housing 4 and the rear cover 12.

The rear cover 12 has a body portion 75 formed contiguously to the front end portion 31 in the form of a rectangular frame serving as an outer housing fitting portion. The body portion 75 of the rear cover 12 converges rearwardly. The arresting projection 32 for engaging with the outer housing 4 is formed on an outer face of the front end portion 31 of the rear cover 12 while a waterproof seal member 77 made of a silicon rubber and having an annular lip 76 is formed integrally on an inner face of the front end portion 31. A silicon rubber pouring hole 78 is formed in the front end portion 31. The seal member 77 is engaged and closely contacted with an outer face of the inner wall rear end portion 21 of the outer housing 4. A pair of lead portions 80 for leading out the shield cables 8 are formed on a rear end wall 79 of the body portion 75 of the rear cover 12 as shown in FIG. 3 in which associated members are denoted by reference numerals with the mark "'" added thereto. The annular seal member 14 (13) is formed integrally on the lead portions 80 (80'). The seal member 14 (13) is closely contacted with outer peripheral coating faces 81 (81') of the shield cables 8 (7) to prevent admission of water.

Figure 4:
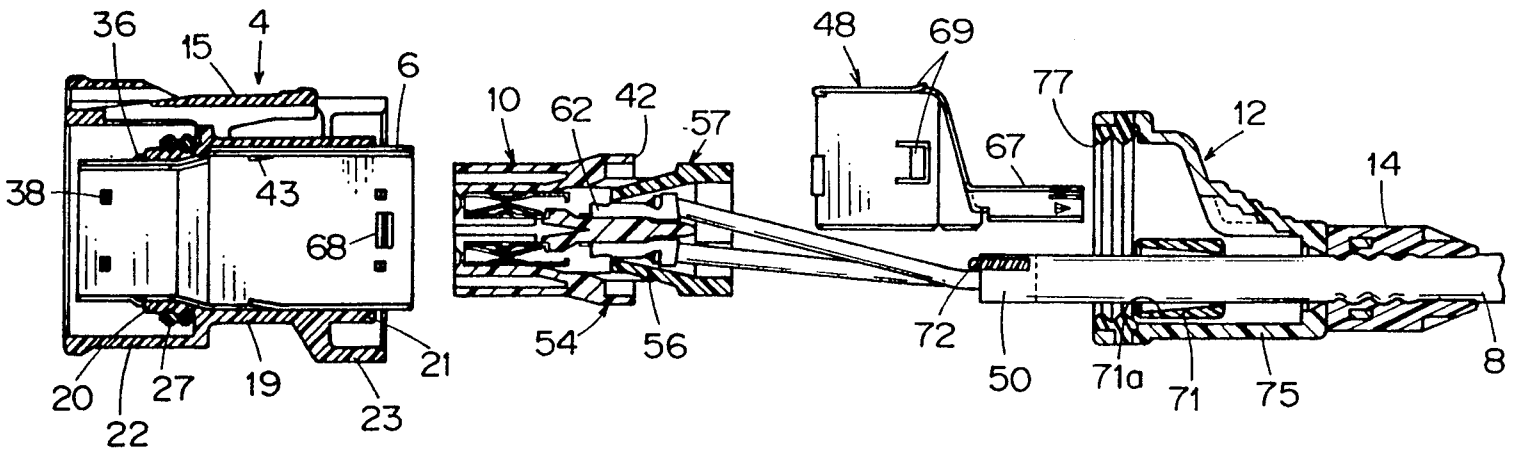
FIG. 4 is a longitudinal sectional view illustrating assembly of the female connector shown in FIG. 2.

It is to be noted that the rear cover 12 and the cap 71 are fitted on the shield cable 8 in advance as shown in FIG. 4 and the female terminals 62 are fixedly connected to the shield cables 8 in this condition.

When the female terminals 62 are to be replaced, the rear cover 12 is removed from the outer housing 4; the cap 71 is pulled off from the contacting portions 49 and 67 of the shells 6 and 48; the rear shell 48 is removed from the metal shell 6; and the rear holder 57 is removed from the inner housing 10. After then, the female terminals 62 can be pulled out readily from the shield cable 8s.

Components of the male connector 1 shown in FIG. 3 will be described briefly. Referring to FIG. 8, the male connector outer hosing 3 has a substantially tubular configuration and has the front end portion 28 with which the female connector outer housing 4 is to be fitted. The metal shell 5 is retained on the inner side of the male connector outer housing 3. The inner housing 9 accommodates male terminals 84 of the shield cables 7 therein and has a rear holder 57' retained at a rear portion thereof. A rear shell 48' is retained at a rear portion of the metal shell 5. The male connector 1 further includes a cap 71' and a rear cover 11. The rear holder 57', rear shell 48', cap 71' and rear cover 11 are same as the corresponding components of the female connector 2.

Figure 5:
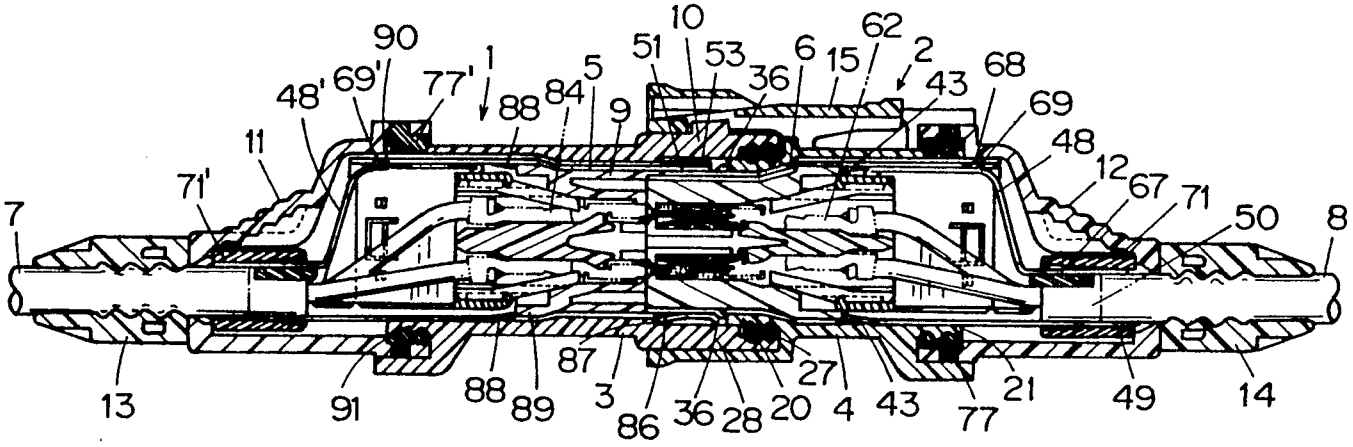
FIG. 5 is a longitudinal sectional view of the shield connector assembly of FIG. 1 when the male and female connectors shown in FIGS. 3 and 2, respectively, are fitted with each other.
Figure 6:
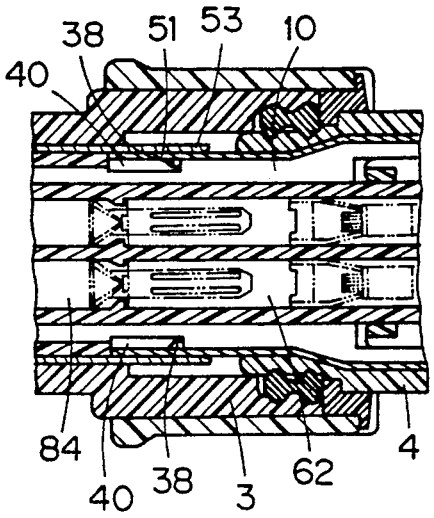
FIG. 6 is an enlarged partial longitudinal sectional view of the shield connector assembly of FIG. 1 in the condition shown in FIG. 5.
Figure 7:
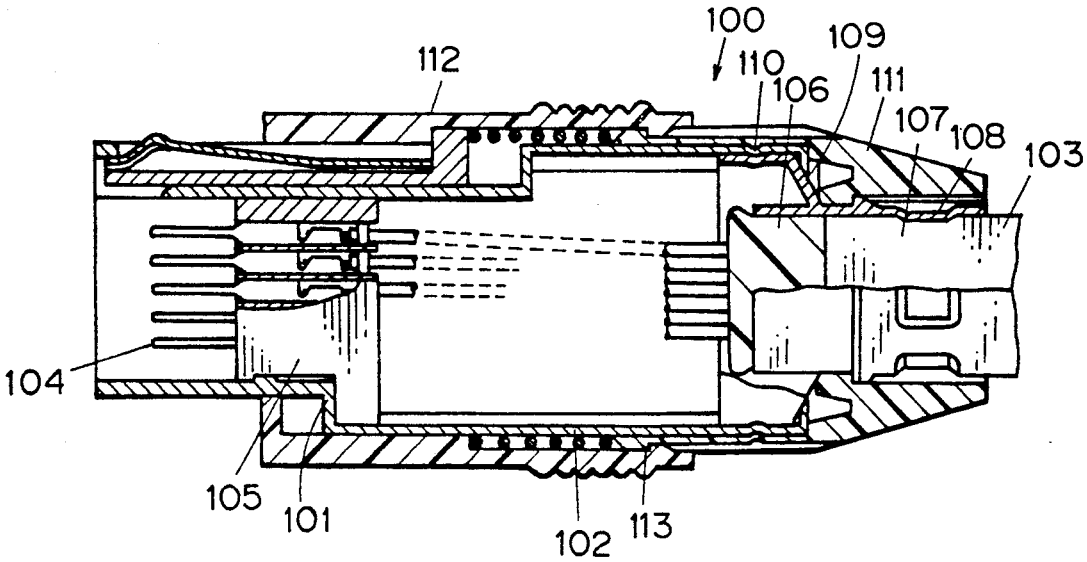
FIG. 7 PRIOR ART
FIG. 7 is a longitudinal sectional view of an exemplary conventional shield connector.

The male connector 1 and the female connector 2 are shown in a fitted condition in FIG. 5 and more in detail in FIG. 6 in both of which the male connector 1 is shown on the left side while the female connector 2 is shown on the right side. The front end portion 28 of the male connector outer housing 3 is fitted with the inner wall front end portion 20 of the female connector outer housing 4 with the waterproof seal member 27 interposed therebetween while the locking arm 15 is engaged with the arresting projection 17 to arrest the male connector 1 and the female connector 2 with each other. The inner housings 10 and 9 are contacted at the front end faces thereof with each other, and the male terminals 84 are fitted in and coupled to the female terminals 62.

The outwardly extending arresting projections 36 of the metal shell 6 of the female connector 2 are engaged with the front end portion 20 of the outer housing 4 to arrest the outer housing 4, and the rear end portion 58 of the inner housing 10 is engaged with the inwardly extending arresting pawls 43 of the metal shell 6 to arrest the inner housing 10. The inwardly extending arresting projections 38 of the metal shell 6 are engaged in the guide grooves 40 of the inner housing 10 as shown in FIG. 6.

The front end portion 53 of the metal shell 5 of the male connector 1 is fitted on the outer periphery of the front end portion 51 of the metal shell 6 of the female connector 1, and a pair of outwardly extending arresting pawls 86 of the metal shell 5 are engaged with a step 87 on the front end portion 28 of the male connector outer housing 3 to arrest the male connector outer housing 3. Similarly, a pair of inwardly extending arresting pawls 88 of the metal shell 5 are engaged with a rear end portion 89 of the inner housing 9 of the male connector 1 to arrest the inner housing 9.

The shells 48 and 48' are retained on the metal shells 6 and 5 with the arresting pawls 69 and 69' thereof engaged with the arresting holes 69 and 90 of the latter, respectively. The arresting projection 32 of the rear cover 12 of the female connector 2 is engaged with the flexible locking tab 34 at the rear end portion of the outer housing 4, and the inner wall rear end portions 21 and 91 of the outer housings 4 and 3 are engaged and closely contacted with the inner faces of the waterproof seal members 77 and 77' of the rear covers 12 and 11, respectively.

The resin cap 71 holds the semi-annular contacting portions 49 and 67 of the metal shell 6 and the rear shell 48 tightly on the shield portions 50 of the shield cables 8. A rear end portion of the resin cap 71 is contacted with a bottom portion of the rear cover 12 to prevent inadvertent loosening of the semi-annular contacting portions 49 and 67. Further, the waterproof seal members 14 and 13 at the rear portions of the rear covers 12 and 11 are contacted closely with the outer peripheries of the shield cables 8 and 7 to prevent admission of water into the shield connector assembly together with the seal members 27 and 77.

Having now fully described the invention, it will be apparent to one of ordinary skill in the art that many changes and modifications can be made thereto without departing from the spirit and scope of the invention as set forth herein.

What is claimed is:

1. A demountable shield connector, comprising:

a tubular outer housing made of an insulating resin material;

a tubular metal shell inserted in and retained on said outer housing and having a semi-annular contacting portion formed at a rear portion thereof;

an inner housing made of an insulating resin material and inserted in and retained on said metal shell;

a shield cable;

a plurality of terminals removably accommodated in said inner housing and connected to said shield cable;

a rear shell fitted in and removably retained at a rear portion of said metal shell in such a manner as to close a rear end opening of said metal shell and having a semi-annular contacting portion formed at a rear portion thereof for cooperating with said semi-annular contacting portion of said metal shell;

an annular cap made of an insulating resin material for removably holding therein said semi-annular contacting portions of said metal shell and said rear shell in an opposing relationship with each other with a shield portion of said shield cable inserted between said semi-annular contacting portions; and a rear cover made of a synthetic resin material and fitted with and removably retained at a rear end portion of said outer housing, said shield cable extending through said rear cover.

2. A demountable shield connector as claimed in claim 1, wherein a waterproof seal rubber member is provided integrally at each of a portion of said rear cover from which said shield cable extends outwardly and another portion of said rear cover at which said rear cover is fitted with said metal shell; and a seal rubber member is fitted at a front end portion of said outer housing for contacting with the outer housing of a companion shield connector adapted to cooperate with said shield connector to make up a shield connector assembly.

3. A demountable shield connector as claimed in claim 1, wherein said annular cap has an inner circumferential face the diameter of which increases away from said metal shell so as to facilitate insertion of said semi-annular contacting portions of said metal shell and said rear shell into said annular cap.

4. A demountable shield connector as claimed in claim 1, further comprising a holder removably retained on said inner housing and holding said terminals thereon.

* * * * *